US006855381B2

(12) United States Patent
Dietrich et al.

(10) Patent No.: US 6,855,381 B2
(45) Date of Patent: Feb. 15, 2005

(54) MEANS OF APPLYING A PRINTED IMAGE TO A TEXTILE SUBSTRATE

(75) Inventors: Jan Dietrich, Kreuzlingen (CH); Peter Kummer, Neukirch (CH); Ilona Stiburek, Zurich (CH)

(73) Assignee: Star Coating AG, Niederhasli (CH)

( * ) Notice: Subject to any disclaimer, the term of this patent is extended or adjusted under 35 U.S.C. 154(b) by 0 days.

(21) Appl. No.: 09/942,045

(22) Filed: Aug. 30, 2001

(65) Prior Publication Data

US 2002/0054982 A1 May 9, 2002

(30) Foreign Application Priority Data

Aug. 30, 2000 (EP) ..... 00118168

(51) Int. Cl.[7] ..... B41M 5/40

(52) U.S. Cl. ..... 428/32.12; 428/32.18; 428/32.24; 428/32.25; 428/32.35; 428/32.38

(58) Field of Search ..... 428/32.12, 32.18, 428/32.24, 32.25, 32.35, 32.38, 195, 206, 211, 213, 220, 327, 329, 331, 334, 423.1, 474.4, 480, 500, 914

(56) References Cited

U.S. PATENT DOCUMENTS

| | | | | | |
|---|---|---|---|---|---|
| 4,537,809 | A | * | 8/1985 | Ang et al. | 428/41 |
| 5,139,917 | A | * | 8/1992 | Hare | 430/138 |
| 5,242,739 | A | | 9/1993 | Kronzer et al. | 428/200 |
| 5,501,902 | A | | 3/1996 | Kronzer | 428/323 |
| 6,017,611 | A | * | 1/2000 | Cheng et al. | 428/32.12 |
| 6,071,368 | A | | 6/2000 | Boyd et al. | 156/240 |
| 6,080,261 | A | * | 6/2000 | Popat et al. | 156/240 |
| 6,087,061 | A | * | 7/2000 | Hare et al. | 430/256 |
| 6,200,668 | B1 | * | 3/2001 | Kronzer | 428/195 |

FOREIGN PATENT DOCUMENTS

| | | |
|---|---|---|
| DE | 25 38 097 | 8/1975 |
| DE | 197 31 498 | 11/1997 |
| DE | 299 02 145 | 7/1999 |
| EP | 0 805 049 | 11/1997 |
| EP | 0 850 786 | 12/1997 |
| WO | 98/30749 | 7/1998 |

* cited by examiner

*Primary Examiner*—B. Shewareged
(74) *Attorney, Agent, or Firm*—Foley & Lardner LLP

(57) ABSTRACT

The present invention describes a transfer system of images produced by an ink jet printer to a textile substrate, comprising a backing and mounted thereon at least one melt transfer ink absorption layer with a matrix comprising at least one meltable polymer material into which fine particles of a filler capable of ink absorption have been embedded.

13 Claims, No Drawings

MEANS OF APPLYING A PRINTED IMAGE TO A TEXTILE SUBSTRATE

BACKGROUND OF THE INVENTION

The present invention relates to a means by which printed images, especially those produced using an ink jet printer, may be transferred to a textile substrate. The system allows the images to be applied by the action of heat and pressure, by means for example of an iron.

Systems with which printer-produced images may be applied to textile substrates such as articles of clothing, especially T-shirts and sweatshirts, bags and the like in a simple procedure are increasingly being demanded by the consumer. The reason for this is that a high percentage of households now possess a computer with a printer connected to it, in many cases a colour printer. The images produced by the computer can therefore be transferred without problems to a substrate, generally paper, using the printer. As a result of the electronic media nowadays available, in conjunction with current communication techniques, it is possible to produce images from a virtually infinite variety of sources. Digital still cameras, video cameras, and the Internet are just some of those that may be mentioned. As a result, many consumers foster the desire to print the images available via the computer and to transfer them to a textile substrate such as an item of clothing. This should be realizable as simply as possible.

For this purpose, the prior art proposes a variety of solutions. U.S. Pat. No. 5,501,902 discloses a printable material consisting of a first support layer on which there is a second layer of a material which consists of a film-forming binder material and particles of a thermoplastic polymer with particle sizes of up to max. 50 $\mu$m. The particles consist of polyolefins, polyesters and ethylene-vinyl acetate copolymers. The printable material may be configured so that it is able to accept ink jet-printed images and to transfer them by the action of heat to a textile substrate. In this embodiment, an ink viscosity modifier is added; in order to achieve transferability to the substrate, the second layer includes a cationic polymer; in that case there is also, preferably, an additional melt transfer layer between the first support layer and the second layer.

DE 197 31 498 discloses an ink transfer sheet for applying ink jet-printed images to a textile substrate. The transfer sheet comprises a backing layer on which there is an interlayer of a meltable material which serves for fixing on the substrate. Above the interlayer there is an ink receiver layer on which there is applied in turn a layer of a quaternary ammonium salt, which serves to fix the ink.

Finally, WO 98/30749 discloses an ink transfer system comprising a substrate material, a melt transfer layer applied to the substrate material, and at least one ink-absorbing layer present on the said melt transfer layer. The system is characterized in that the ink-absorbing layer comprises a mixture of a highly porous filler and a binder, the molecules of the filler being capable of forming chemical bonds with the dye molecules of the ink. The fillers used are special highly porous polyamides which are intended to enter into a chemical bond with the dye.

The reasonably capable transfer systems disclosed in the aforementioned documents are all of a construction in which, on the first layer, which acts as the substrate, there is first a meltable layer which by the time of transfer melts by means of the applied heat and, following solidification, ensures adhesion to the textile substrate. Atop this layer there is then at least one further layer which serves to absorb the ink and has corresponding materials, generally an organic binder and also substances which are intended to ensure ink absorbability.

The placing of at least two different layers, however, is comparatively complex and generally undesirable, since it is necessary to assemble different materials for these layers which must then each be applied, meaning that the backing must also be coated a number of times accordingly. As a result, coating is time consuming, and the use of different materials necessitates a plurality of mixing operations.

SUMMARY OF THE INVENTION

It is an object of the present invention to provide a system for transferring images printed with ink jet printers to a substrate, the said system having a simpler construction than the transfer systems known to date, while being just as capable.

The foregoing and other objects are achieved by means of a system for transfer of images produced by an ink jet printer to a textile substrate, comprising a backing and mounted thereon at least one melt transfer ink absorption layer with a matrix comprising at least one meltable polymer material into which fine particles of a filler capable of ink absorption have been embedded. Further objects, features and advantages of the present invention will become apparent from consideration of the preferred embodiments that follow.

DETAILED DESCRIPTION OF THE PREFERRED EMBODIMENTS

It has been found that the simple construction of the transfer system according to the present invention surprisingly ensures simple and effective transfer of images produced by ink jet printers to textile substrates. The system of the invention provides outstanding results. The application of two separate layers for absorbing the ink and for fixing the system on the substrate is unnecessary.

The system of the invention therefore has a simple structure in which a layer serving to absorb the ink and to connect to the textile substrate is mounted on a backing. Since, depending on procedure, during the application of the image obtained by the printing operation to the textile substrate, the backing remains on the system and is only removed thereafter, it is necessary for the backing to possess a certain heat resistance. Melting or even breakdown of the backing during application must be avoided. Consequently, the substrate must withstand the customary temperatures which are attained by the devices used in the course of application, such as irons or special presses. Preferably, the heat resistance of the backing must be situated at levels of $\geqq 250°$ C.

Moreover, the backing is required, to have abhesive properties (release properties), in order that it may be detached readily from the layer connected to it.

The backings used may be based on paper, polymer or textile. Examples of suitable backing materials include silicone paper, pseudosilicone paper (extra-smooth, blanched papers), wax paper, baking paper and polyesters. Preference is given to using siliconized paper or a pseudosilicone paper.

The melt transfer ink absorption layer has a polymer matrix into which a filler has been embedded.

On the one hand, the meltable polymer material used as matrix material has binding properties and therefore serves as a binder for the filler particles. On the other hand, the meltable polymer material establishes the connection to the fibre of the textile substrate, thereby ensuring secure transfer and secure adhesion of the image produced.

Suitable materials belong to the class of the thermoplastics. They are required to have a melting range which allows the material to melt on exposure to heat, which may be achieved with just a conventional iron, and in doing so to act both as a binder for the filler and to establish the connection to the fibre. In general, this range is situated at levels of 100 to 250° C., preferably 130 to 200° C.

As material for the matrix in which the filler has been embedded, it is possible in principle to use all polymers which have an appropriate melting range and which possess the necessary properties of bonding both to the fibre and to the filler. Examples of suitable thermoplastics include polyesters, ethylene-vinyl acetate copolymers, polyamides, nylon, epoxides, polyacrylates, styrene-butadiene copolymers, nitrite rubber, polyvinyl chloride, polyvinyl acetate, ethyleneacrylate copolymers and ethylene-acrylate copolymers in combination with polyester. Preferred matrix materials are polyamides, ethyleneacrylate copolymers, and ethylene-acrylate copolymers in combination with polyester.

The above-mentioned materials may be used alone or in any desired combination with one another.

The filler material embedded in the matrix material and present in the melt transfer absorption layer serves to absorb the ink applied by the printer to the surface of the system. This material is generally in the form of particles which are surrounded by the matrix material and fixed by it. Suitable fillers for use in accordance with the present invention are organic and inorganic fillers or combinations within these types of filler or else combinations of the two types with one another. Suitable fillers are required to have appropriate ink absorption capacities and compatibility with the matrix material.

Examples of suitable organic fillers include melamine-formaldehyde resins, polyacrylates, polymethacrylates, polyurethanes, crosslinked polyvinylpyrrolidone, polyamides, formaldehyde resins and urea-formaldehyde resins.

Examples of commercially available polymers of the types mentioned above are given in the table below:

| Filler type | Commercial name |
|---|---|
| Melamine-formaldehyde resin | Pergopack ® M (Martinswerk GmbH, D-Bergheim) |
| Polyacrylate | Decosilk ® (Microchem, CH-Uetikon) |
| Polyurethane | Decosoft ® (Microchem, CH-Uetilcon) |
| Organic polymers (urea compounds) | Cerafluor ® 920 (Byk-Cera BV, NL-Deventer) |
| Polyvinylpyrrolidone | PVPP (ISP, New Jersey, USA) |
| Polyvinylpyrrolidone | Luvicross ® M (BASF AG, D-Ludwigshafen) |
| Polyamide | Orgasol ® (Atochem SA, France) |

Organic fillers used with preference are crosslinked polyvinylpyrrolidone and polyamides.

In particular, the polymers obtainable under the product names Orgasol® and Luvicross® M are suitable for the inventive use.

The organic fillers are present in particle sizes of from 1 to 50 $\mu$m, preferably from 5 to 30 $\mu$m.

Examples of inorganic fillers include silicon dioxide in various modifications, $Al_2O_3$, $TiO_2$, $BaSO_4$ and aluminosilicates, preferably aluminosilicates and silicon dioxide. Preference is given to silicon dioxide obtainable under the names Kiebosol® (Clariant) and CAB-O-SPERSE® (Cabot, USA) and also to aluminosilicates which are likewise available under the name CAB-O-SPERSE®.

In general, the inorganic fillers are likewise present in particle sizes of from 1 to 50 $\mu$m, preferably from 5 to 30 $\mu$m. It is, however, also possible for smaller particle sizes to be present. This is the case, for example, with fillers of the Klebosol and CAB-O-SPERSE® type, which are present in the form of particles with sizes from 1 to 100 nm.

The melt transfer ink absorption layer comprising matrix material and filler generally possesses a layer thickness of from 20 to 100 $\mu$m, preferably from 30 to 50 $\mu$m.

Matrix material and filler are generally used in a matrix material/filler weight ratio (solids/solids) of from 1:1 to 1:10, preferably from 1:2 to 1:5, in the melt transfer ink absorption layer.

In the simplest embodiment of the present invention, the melt transfer ink absorption layer is homogeneous in construction and is applied in a single process step. In this case, therefore, there is only one single layer on the backing. It is, however, also possible to apply two or more melt transfer ink absorption layers to the backing. In this case the layers may each have the same composition or may have different compositions.

Accordingly, it is possible, for instance, to implement a grading of the filler so that its concentration increases or decreases in one direction. It is also possible, for example, to implement a grading of the matrix material such that when a combination of two or more matrix materials is used the concentration of one or more materials decreases in one direction. The direction in which such a concentration gradient is chosen depends on a variety of factors known to the person skilled in the art; for example, on whether application takes place in inverse or normal function (see below), on the type of textile (for example cotton, cotton/PET blend, nylon, synthetic leather, etc.), on the type of transfer (iron or press), or on the ink used in the ink jet printer.

Even if there are two or more melt transfer ink absorption layers on the backing, the total thickness of the layers is generally within the range specified above of from 20 to 100 $\mu$m, preferably from 30 to 50 m.

In one embodiment of the present invention, a dulling material is present in the transfer system of the invention. This dulling material is located on that surface of the melt transfer ink absorption layer which faces the viewer after the printed system has been applied to a textile substrate. Consequently, if the printed system is applied by the inversion process, the dulling material is located on the surface of the melt transfer ink absorption layer that faces the backing. If the image is applied by the normal process, the dulling material is located on the surface of this layer that faces away from the backing.

The dulling material may be incorporated in the surface of the melt transfer ink absorption layer, or may be mounted thereon in an extra layer.

Dulling materials used are those organic and inorganic materials which are also used as fillers in the melt transfer ink absorption layer, i.e. melamine-formaldehyde resins, polyacrylates, polymethacrylates, polyurethanes, crosslinked polyvinylpyrrolidone, polyamides, silicon dioxide in various modifications, $Al_2O_3$, $TiO_2$, $BaSO_4$ and aluminosilicates. When selecting the dulling materials it should be borne in mind that the materials chosen must be non-meltable As the dulling material it is preferred to use one of the above-mentioned inorganic fillers, especially Sylojet P 412 and Sylojet P 416.

The fraction of these fillers in the region or in the layer in which they are used as dulling materials is chosen to be sufficiently high that a dulling effect is achieved. The fillers used as dulling material may be either identical with or different from the fillers used for ink absorption.

These dulling effects may also be achieved by using a backing with a rough release surface, so that when it is peeled off a rough image surface is formed. Besides the above-mentioned layers, i.e. the backing layer, the melt transfer ink absorption layer and the optional dulling layer, there may be further layers in the system of the invention.

The transfer system of the invention is produced using the customary methods known to a person skilled in the art. In general, the filler and the polymer used as matrix material are mixed with one another. The polymer is dissolved in an appropriate solvent before it is mixed with the filler. Suitable solvents are known to a person skilled in the art and include water and alcohols, such as ethanol and isopropanol.

Combinations of these solvents may also be used. Preference is given to using an ethanol/water mixture.

Subsequently, the resulting mixture is applied to the backing by the customary methods and dried. If desired, the process is repeated for the purpose of applying two or more layers, in which case the layer composition may likewise be varied.

Further layers may be applied on top of the system thus obtained, if this is desired: the dulling layer is an example.

The application of an image to the desired textile substrate takes place as follows:

In one embodiment (inversion process) the image produced by the printer is printed in mirror inversion onto the transfer system of the invention. The system is then placed on the substrate in such a way that the melt transfer ink absorption layer is in contact with the substrate. The system is then applied to the substrate at temperatures at which the polymer used as matrix material melts, preferably by means of ironing or using a special press device. After cooling, the backing, which is at the top, is peeled off (cold peel), after which the printed image becomes visible.

After the cold peel it is also possible to carry out what is known as a hot peel. By this means it is possible, for example, to adjust the gloss of the surface (matt or semi-matt).

For the hot peel, a thin layer of the substrate, preferably standard paper or siliconized paper, is placed on the image obtained after the cold peel. The system is then heated above the melting point of the polymer used as matrix material, by ironing, for example. Thereafter the substrate is quickly peeled off. This generally achieves a better connection between the textile substrate and the matrix material.

In a further embodiment of the present invention, the image is printed without mirror inversion (normal process). In this case application takes place as in the inversion process, at which point first the backing layer is peeled off and the side of the transfer system on which the backing was is placed onto the substrate. Application of the image then takes place again by the action of heat and, where appropriate, pressure.

The invention is now illustrated in the following example:

Polyamide to ethylene-acrylate copolymer with polyester in a ratio of 7:3 (solids/solids) is dissolved in ethanol/water (3:1). Luvicross/Orgasol (1:1) is admixed.

Polymer:filler ratio=1:2

Solids content of the finished mixture: 20%.

The finished mixture is applied to a 90 g/m$^2$ sheet of silicone paper (A4 format) and dried at 105° C. for 1 minute to give a dry film thickness of 30 microns. The coated side is printed in an ink jet printer (HP 950 C.) in "transfer paper for ironing" mode. Thereafter, the image side with the printed pattern is placed on a T-shirt and transferred using an iron, with a transfer time of 20 seconds. The transfer temperature of the iron is given by the button setting "cotton". The silicone paper is then peeled off.

The priority document, European Patent Application No. 00118168.4 filed Aug. 30, 2000 is incorporated herein by reference in As used herein and in the following claims, articles such as "the", "a" can connote the singular or plural.

All documents referred to herein are specifically incorporated herein by reference in their entireties.

What is claimed is:

1. A system for transfer of images produced by an ink jet printer to a textile substrate, comprising a backing material and mounted thereon at least one melt transfer ink absorption layer with a matrix comprising at least one meltable polymer material into which fine particles of a filler capable of absorbing ink compositions suitable for an ink jet printer have been embedded, and further comprising a non-meltable dulling material, wherein the filler is selected from organic and inorganic materials and comprises at least one of a formaldehyde resin, a melamine-formaldehyde resin, a polyacrylate, a polymethacrylate, a polyurethane, a cross linked polyvinylpyrrolidone, a polyamide, silicon dioxide, $Al_2O_3$, $TiO_2$, $BaSO_4$, and an aluminosilicate, wherein the polyamides are one of lauryllactum polymers, caprolactum polymers, and a copolymer of lauryllactum and caprolactum thereof.

2. A transfer system according to claim 1, wherein the meltable polymer material is selected from the group consisting of polyesters, ethylene-vinyl acetate copolymers, polyamides, nylon, epoxides, polyacrylates, styrene-butadiene copolymers, nitrile rubber, polyvinyl chloride, polyvinyl acetate, ethylene-acrylate copolymers and ethylene-acrylate copolymers in combination with polyester.

3. A transfer system according to claim 1, wherein the polymer material has a melting range of from 100 to 250° C.

4. A transfer system according to claim 1, wherein the filler is an organic filler and is present in particle sizes of from 1 to 50 $\mu$m, or the filler is an inorganic filler and is present in particle sizes of from 1 to 50 $\mu$m.

5. A transfer system according to claim 1, wherein matrix material and filler are present in a matrix material/filler weight ratio of from 1:1 to 1:10.

6. A transfer system according to claim 1, wherein the thickness of the melt transfer ink absorption layer is from 20 to 100$\mu$m.

7. A transfer system according to claim 1, wherein the melt transfer ink absorption layer comprises a plurality of layers.

8. A transfer system according to claim 7, wherein in the melt transfer ink absorption layer there is a concentration gradient of the filler and/or of one or more of the matrix materials used.

9. A transfer system according to claim 1, wherein the backing material has adhesive properties, which material is selected from the group consisting of silicone paper, pseudosilicone paper, wax paper, baking paper and polyesters.

10. A transfer system according to claim 9, wherein the backing material has a heat resistance of at least 250° C.

11. A process for producing a transfer system according to claim 1, comprising: mixing the meltable polymer and the filler in an appropriate solvent; applying the mixture to the backing material; and drying the mixture.

12. A process for applying an image produced by an ink jet printer to a textile substrate, comprising the following steps:

mirror-inverted print applying an image to the transfer system according to claim 1;

placing the system onto the textile substrate by the melt transfer ink absorption layer;

heating the transfer system to a temperature at which the matrix material melts; and optionally, implementation of a hot peel.

13. A process for applying an image produced by an ink jet printer to a textile substrate, comprising the following steps:

right-sided print applying an image produced by a computer to the transfer system according to claim 1;

peel removing the backing material, placing the system onto the textile substrate by that side of the melt transfer ink absorption layer on which the backing material was;

healing the transfer system to a temperature at which the matrix material melts;

peel removing a backing material present on the side of the system opposite of the substrate, after cooling has taken place; and optionally, implementation of a hot peel.

* * * * *